US009835035B2

(12) United States Patent
Mueller et al.

(10) Patent No.: US 9,835,035 B2
(45) Date of Patent: Dec. 5, 2017

(54) CAST-IN COOLING FEATURES ESPECIALLY FOR TURBINE AIRFOILS

(71) Applicant: Howmet Corporation, Independence, OH (US)

(72) Inventors: Boyd A. Mueller, Whitehall, MI (US); Michael A. Pepper, Grand Haven, MI (US); Darren K. Rogers, Muskegon, MI (US); Gail R. Cole, Muskegon, MI (US)

(73) Assignee: Howmet Corporation, Independence, OH (US)

( * ) Notice: Subject to any disclaimer, the term of this patent is extended or adjusted under 35 U.S.C. 154(b) by 627 days.

(21) Appl. No.: 13/815,595

(22) Filed: Mar. 12, 2013

(65) Prior Publication Data

US 2014/0271129 A1 Sep. 18, 2014

(51) Int. Cl.

| | |
|---|---|
| ***F01D 5/18*** | (2006.01) |
| ***B22C 7/02*** | (2006.01) |
| ***B22C 9/04*** | (2006.01) |
| ***B22C 9/10*** | (2006.01) |
| ***B22C 21/14*** | (2006.01) |

(52) U.S. Cl.

CPC ..... *F01D 5/187* (2013.01); *B22C 7/02* (2013.01); *B22C 9/04* (2013.01); *B22C 9/10* (2013.01); *B22C 21/14* (2013.01); *F01D 5/186* (2013.01)

(58) Field of Classification Search

CPC . F01D 5/18; F01D 5/187; F01D 5/188; F01D 5/186; B22C 9/00; B22C 9/10; B22C 9/103; B22C 9/108

USPC ..... 415/115; 29/889.721; 416/97 R, 416/90 R–91, 95; 164/6, 23, 28, 30–32, 164/137, 369, 516; 249/64, 142

See application file for complete search history.

(56) References Cited

U.S. PATENT DOCUMENTS

| | | | | |
|---|---|---|---|---|
| 3,965,963 A * | 6/1976 | Phipps | B22C 9/24 | 164/122.1 |
| 4,283,835 A | 8/1981 | Obroacta et al. | 29/527 | |
| 4,384,607 A * | 5/1983 | Wood | B22C 9/04 | 164/132 |

(Continued)

FOREIGN PATENT DOCUMENTS

| | | |
|---|---|---|
| EP | 1769862 | 4/2004 |
| GB | 2379632 | 3/2003 |

(Continued)

*Primary Examiner* — Alexander Comley
(74) *Attorney, Agent, or Firm* — Greenberg Traurig, LLP

(57) ABSTRACT

A method is provided for making a mold for casting advanced turbine airfoils (e.g. gas turbine blade and vane castings) which can include complex internal and external air cooling features to improve efficiency of airfoil cooling during operation in the gas turbine hot gas stream. The method steps involve incorporating at least one fugitive insert in a ceramic material in a manner to form a core and at least a portion of an integral, cooperating mold wall wherein the core defines an internal cooling feature to be imparted to the cast airfoil and the at least portion of the mold wall has an inner surface that defines an external cooling feature to be imparted to the cast airfoil, selectively removing the fugitive insert, and incorporating the core and the at least portion of the integral, cooperating mold wall in a mold for receiving molten metal or alloy cast in the mold.

30 Claims, 3 Drawing Sheets

(56) References Cited

U.S. PATENT DOCUMENTS 4,574,451 A * 3/1986 Smashey ..... B23P 15/04 164/132
5,295,530 A 3/1994 O'Connor et al. ..... 164/9
5,296,308 A * 3/1994 Caccavale ..... B22C 9/04 164/361
5,503,218 A * 4/1996 Campion ..... B22C 9/04 164/34
5,524,696 A 6/1996 Osborne et al. ..... 164/34
5,545,003 A 8/1996 O'Connor et al. ..... 415/115
5,820,774 A * 10/1998 Dietrich ..... B22C 9/10 164/369
5,989,476 A 11/1999 Lochard et al. ..... 264/401
6,206,638 B1 * 3/2001 Glynn ..... F01D 5/186 415/115
6,505,678 B2 1/2003 Mertins ..... 164/516
6,530,416 B1 * 3/2003 Tiemann ..... B22C 21/14 164/122.1
6,626,230 B1 * 9/2003 Woodrum ..... B22C 1/22 164/137
7,093,645 B2 8/2006 Grunstra et al. ..... 164/369
7,207,375 B2 4/2007 Turkington et al. ..... 164/516
7,258,156 B2 8/2007 Santeler ..... 162/416
7,413,001 B2 8/2008 Wang et al. ..... 164/516
7,487,819 B2 2/2009 Wang et al. ..... 164/28
7,624,787 B2 12/2009 Lee et al. ..... 164/516
7,913,743 B2 3/2011 Bedzkyk ..... 164/45
7,938,168 B2 5/2011 Lee et al. ..... 164/516
2003/0075300 A1 * 4/2003 Shah ..... B22C 9/04 164/369
2004/0202542 A1 * 10/2004 Cunha ..... B22C 9/103 416/97 R
2005/0258577 A1 * 11/2005 Holowczak ..... B28B 7/0014 264/600
2006/0086479 A1 * 4/2006 Parkos, Jr. ..... B22C 9/10 164/369
2006/0292005 A1 * 12/2006 Pietraszkiewicz ..... B22C 7/06 416/97 R
2007/0286729 A1 * 12/2007 Kopmels ..... F01D 5/147 416/97 R
2008/0135202 A1 * 6/2008 Lee ..... B22C 9/101 164/28
2008/0138209 A1 * 6/2008 Cunha ..... B22C 9/04 416/97 R
2009/0175733 A1 * 7/2009 Poon ..... B22C 9/10 416/97 R
2011/0132562 A1 6/2011 Merrill ..... 164/9
2011/0135446 A1 * 6/2011 Dube ..... B22C 9/04 415/115
2012/0269648 A1 * 10/2012 Lee ..... F01D 5/187 416/97 R
2012/0285648 A1 * 11/2012 Mueller ..... B22C 7/02 164/6

FOREIGN PATENT DOCUMENTS

JP 55 114 439 9/1980
JP 2 258 137 10/1990
JP 7 001 075 1/1995
JP 2000246392 9/2000
JP 2000 297 606 10/2000
JP 2004 076 731 3/2004

* cited by examiner

CAST-IN COOLING FEATURES ESPECIALLY FOR TURBINE AIRFOILS

FIELD OF THE INVENTION

The present invention relates to the casting of metal or alloy articles of manufacture and more particularly, to a method of making a ceramic core and cooperating integral ceramic mold, or mold portion, useful though not limited to, the casting a turbine airfoil with cast-in cooling features and enhanced external casting wall thickness control.

BACKGROUND OF THE INVENTION

Most manufacturers of gas turbine engines are evaluating advanced multi-wall, thin-wall turbine airfoils (i.e. turbine blade or vane) which include intricate air cooling channels to improve efficiency of airfoil internal cooling to permit greater engine thrust and provide satisfactory airfoil service life. However, cooling schemes for advanced high-thrust aircraft engines are complex, often involving multiple, thin walls and non-planar cooling features. The ceramic cores that define these advanced cooling schemes are conventionally formed by forcing ceramic compound into steel tooling, but core complexity is limited by the capabilities of tooling design/fabrication. Therefore, complex advanced cooling schemes often rely on the assembly of multiple ceramic core pieces after firing. Assembly requires specialized labor and results in core dimensional variability due to mismatch between assembled core components, while the fragile nature of fired cores results in elevated handling scrap, and compromises to the advanced cooling schemes are required to allow for assembly and positioning of the core assembly or multiple core pieces in the subsequent casting.

Some core geometries require the formation of multiple fugitive core inserts to define features that do not operate in common planes, including: (1) multiple skin core segments, (2) trailing edge features (e.g., pedestals and exits), (3) leading edge features (e.g., cross-overs), and (4) features that curve over the length of the airfoil. Forming multiple fugitive inserts and assembling them in a core die presents a similar problem to that created by core assembly. Intimate contact between inserts may not be insured when they are loaded into a core die, either due to dimensional variability in the individual inserts or poor locating schemes in the core die. Subsequent molding of the ceramic core material may result in formation of flash at the union of two fugitive insert segments. While flash is common in ceramic core molding and is removed as part of standard processing, flash around or between fugitive inserts may reside in hidden, internal cavities or as part of intricate features, where inspection and removal is not possible. Any such flash remaining in the fired ceramic core can alter air flow in the cast blade or vane.

U.S. Pat. Nos. 5,295,530 and 5,545,003 describe advanced multi-walled, thin-walled turbine blade or vane designs which include intricate air cooling channels to this end.

In U.S. Pat. No. 5,295,530, a multi-wall core assembly is made by coating a first thin wall ceramic core with wax or plastic, a second similar ceramic core is positioned on the first coated ceramic core using temporary locating pins, holes are drilled through the ceramic cores, a locating rod is inserted into each drilled hole and then the second core then is coated with wax or plastic. This sequence is repeated as necessary to build up the multi-wall ceramic core assembly.

This core assembly procedure is quite complex, time consuming and costly as a result of use of the multiple connecting and other rods and drilled holes in the cores to receive the rods. In addition, this core assembly procedure can result in a loss of dimensional accuracy and repeatability of the core assemblies and thus airfoil castings produced using such core assemblies.

U.S. Pat. No. 6,626,230 describes forming multiple fugitive (e.g. wax) thin wall pattern elements as one piece or as individual elements that are joined together by adhesive to form a pattern assembly that is placed in a ceramic core die for molding a one-piece core.

U.S. Pat. No. 7,258,156 describes the use of ceramic cores and refractory metal cores that are used to form trailing edge cooling passage exits or convoluted airfoil cast-in cooling features wherein the cores are removed to define internal cooling features.

Copending application U.S. Ser. No. 13/068,413 filed May 10, 2011, of common assignee herewith, describes a method of making multi-wall ceramic core wherein at least one fugitive core insert is pre-formed and then at least another fugitive core insert is formed in-situ connected to the pre-formed core insert to from complex cores with internal walls that cannot be readily inspected or repaired once the core is formed.

SUMMARY OF THE INVENTION

The present invention provides a method useful for, although not limited to, making a mold for casting of advanced turbine airfoils (e.g. gas turbine blade and vane castings) which can include complex cast-in internal and/or external cooling features to improve efficiency of airfoil cooling during operation in the gas turbine hot gas stream.

An illustrative method involves the steps of incorporating at least one fugitive insert in a ceramic material in a manner to form a core and at least a portion of an integral, cooperating mold wall wherein the core defines an internal feature to be imparted to the cast article and the at least portion of the mold wall has an inner surface that defines an external feature to be imparted to the cast article, selectively removing the fugitive insert, and incorporating the core and the at least portion of the integral, cooperating mold wall in a mold for receiving molten metal or alloy wherein the core defines an internal feature to be imparted to the cast article and the mold wall has an inner surface that defines an external feature to be imparted to the cast article. Solidification of molten metal or alloy in the mold produces such cast-in internal and external features of the cast article.

The present invention can be practiced to form a core with only a portion of an integral cooperating mold wall wherein the missing mold wall portions can be subsequently formed by conventional shell investment molding steps to provide a complete mold shell about the core. Alternately, the present invention can be practiced to form in one step in the first die a ceramic core and a substantially complete integral, cooperating ceramic mold for casting a turbine airfoil or other article of manufacture.

In practice of the present invention to cast a turbine airfoil, certain core surfaces can form cast-in internal cooling features, such as internal cooling air passages with turbulators to increase cooling efficiency, while the inner surface of the integral, cooperating mold wall can form cast-in external cooling air exit holes penetrating the adjacent external airfoil surface, and features on the casting external surface that enhance performance such as features that reduce aerodynamic drag or assist in coating adherance, when the molten metal or alloy is solidified.

Practice of the present invention is advantageous in that complex external cooling features, such as film cooling air exit holes and/or features that reduce aerodynamic drag or assist in coating adherance, can be cast-in external airfoil surfaces in locations and/or orientations that are not possible by post-cast machining operations, such as drilling, with shapes and tapers to improve cooling performance and with improved external and internal casting wall thickness control. Further, the thermal expansion characteristics of the core and cooperating mold wall are matched at least at the local region and can be tailored to provide desired thermal and/or mechanical properties in the mold as a whole or locally to reduce hot tearing in equiaxed castings, local recrystallization in DS/SC castings, and/or provide local grain size control. Moreover, practice of certain embodiments of the invention can be used to reduce or eliminate the extent of conventional investment shelling steps needed to form the mold.

Other advantages of the practice of the present invention will become more readily apparent from the following detailed description taken with the following drawings.

DESCRIPTION OF THE INVENTION

In order to make aero and/or industrial gas turbine engine airfoil cooling air schemes most effective, especially high pressure turbine blade and vanes (hereafter turbine airfoils), internal cooling features, such as air cooling passages, support pedestals, etc. as well as external cooling features, such as film cooling air exit holes, cooling-enhancing turbulators, etc. need to precisely partition and direct the cooling air such that its pressure is controlled and it is directed to the most needed regions of the blade or vane. Practice of the present invention permits production of complex airfoil geometries with complex cast-in internal and external cooling features and enhanced external casting wall thickness control.

Although the present invention will be described below in connection with the casting of advanced turbine airfoils (e.g. gas turbine blade and vane castings) which can include complex cast-in internal and external cooling air features to improve efficiency of airfoil cooling during operation in the gas turbine hot gas stream, the invention is not limited to turbine airfoils and can be practiced to produce other cast articles that include complex cast-in internal and/or external features pursuant to a particular design specification.

Figure 2:
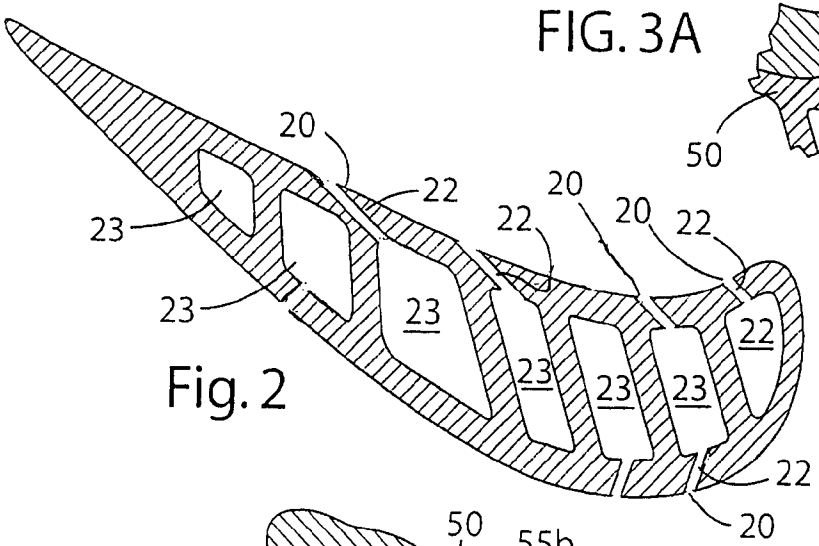
FIG. 2 is a sectional view along a single plane of the metal or alloy turbine blade taken normal to the stacking axis of the turbine blade of FIG. 1 showing the cast-in cooling air exit holes connected to cast-in internal cooling air passages that are formed when the core is removed.
Figure 1:
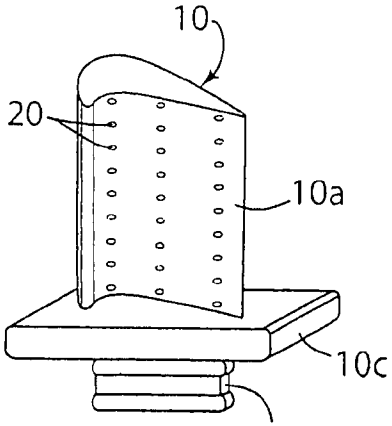
FIG. 1 is a perspective view of a cast metal or alloy turbine blade having a pattern of cast-in cooling air exit holes penetrating the external airfoil surface and communicated to internal cast-in cooling air passages as shown in FIG. 2.

Referring to FIGS. 1 and 2, a cast gas turbine blade 10 is illustrated having an airfoil region 10*a*, a root region 10*b*, and a platform region 10*c* between the airfoil region and the root region. The airfoil region 10*a* is shown having a pattern of cast-in cooling air exit holes 20 communicated to the external airfoil surface and also communicated to cast-in internal cooling air passages 22 leading to and communicated with main cooling air passages 23 that receive cooling air. The particular spatial arrangement and number of cast-in cooling air exit holes 20 and air cooling passages 22, 23 are shown only for purposes of illustration and not limitation since each particular turbine airfoil design can be different in this regard.

The gas turbine blade 10 (or vane) can be cast using conventional nickel based superalloys, cobalt superalloys, titanium, titanium alloys, and other suitable metals or alloys including intermetallic materials. Practice of the present invention is not limited to any particular metal or alloy. Moreover, the turbine blade (or vane) can be cast using different conventional casting processes including, but not limited to, equiaxed casting processes to produce an equiaxed grain turbine blade or vane, directional solidification casting processes to produce a columnar grain turbine blade or vane, and single crystal casting processes to produce a single crystal turbine blade or vane. Practice of the present invention is not limited to any particular casting process.

Figure 3A:
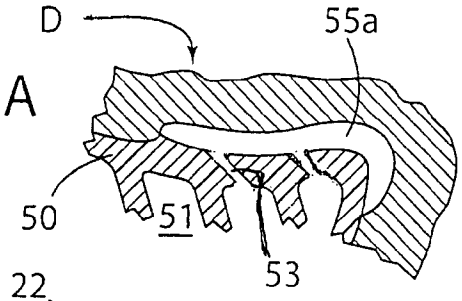
FIG. 3A is an enlarged view of the region A of FIG. 3.
Figure 3:
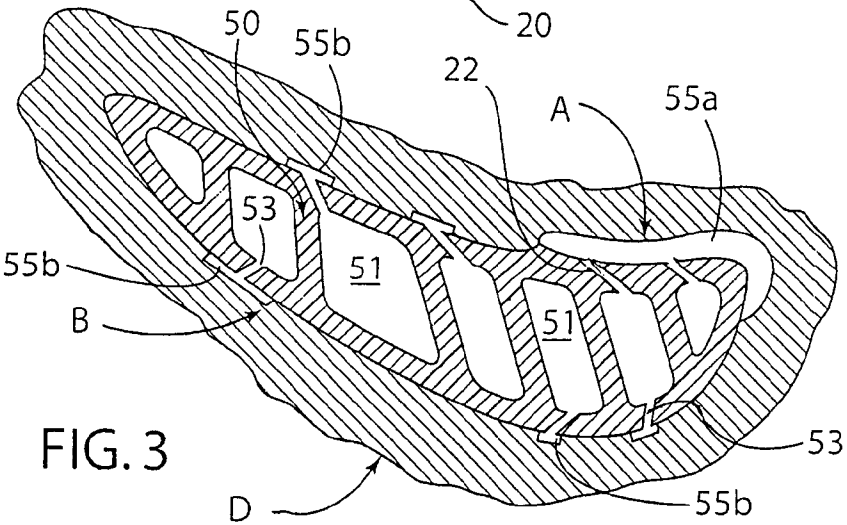
FIG. 3 is a sectional view of a transient (fugitive) insert residing in a first molding die in which ceramic material is injection or transfer molded to incorporate the transient insert into a ceramic component useful for casting after the insert is removed.
Figure 5:
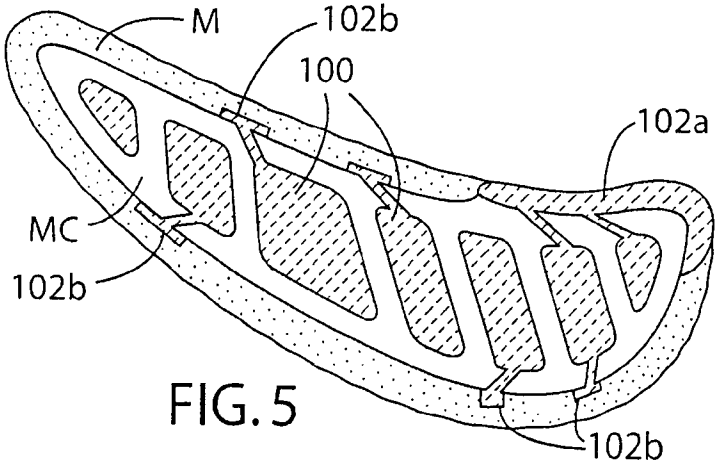
FIG. 5 is a sectional view of the transient (fugitive) insert after the ceramic core and integral, cooperating mold walls are formed and after a mold shell is invested about regions of the core so as to provide a complete mold shell.
Figure 4:
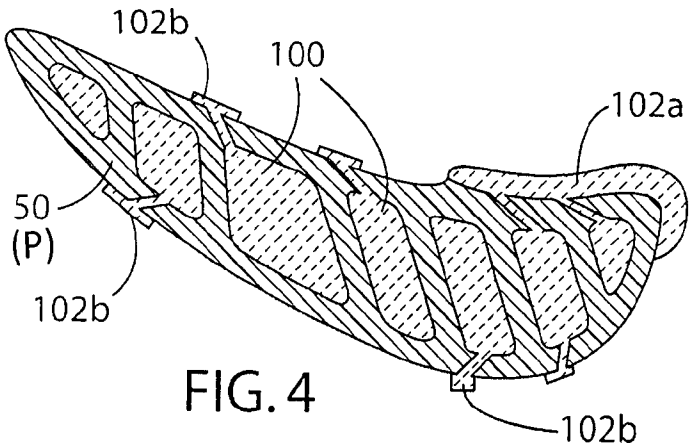
FIG. 4 is a sectional view of the transient (fugitive) insert after the ceramic core and integral, cooperating mold walls are formed.
Figure 6C:
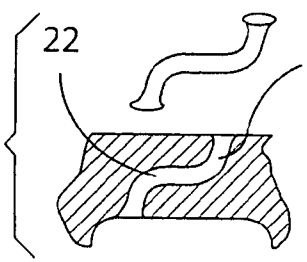
FIG. 6A through 6E illustrate different types of cooling air hole configuration that can be formed pursuant to illustrative embodiments of the invention.
Figure 6B:
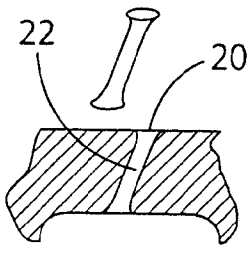
Figure 6A:
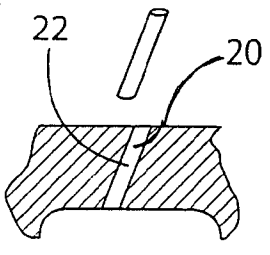
Figure 6E:
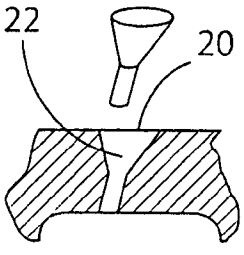
Figure 6D:
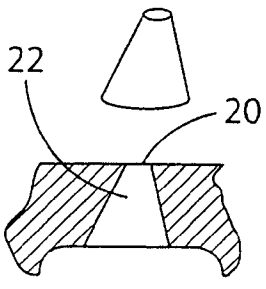

Referring to FIGS. 3, 4 and 5, an illustrative method embodiment pursuant to the present invention is shown for purposes of illustration and not limitation. In this embodiment, a preformed transient (fugitive) insert 50 is provided for positioning in a core molding die D as shown best in FIG. 3, which illustrates the fugitive insert 50 as including internal insert main cavities 51 and internal insert passages 53 communicated to associated mold wall-forming cavities 55*a*, 55*b* formed as shown by cooperation of the insert surfaces and the inner surface recesses of the molding die D. The cavities 51, passages 53, and cavities 55*a*, 55*b* are subsequently filled with the ceramic material by injection or transfer molding, or pouring of a suitable ceramic material. The preformed fugitive insert 50 can be molded as one-piece, over-molded in two or more injections, or as multiple injection molded pieces or injection molded partial pieces, and assembled together. Over-molding to provide multi-piece fugitive insert is described in copending U.S. application Ser. No. 13/068,413, the teachings of which are incorporated herein by reference to this end.

Moreover, although the fugitive insert 50 is shown for convenience as a single piece in FIGS. 3 and 4, fugitive insert 50 can comprise multiple, preformed insert components or pieces molded individually and then assembled together and placed in the molding die D. The preformed multiple insert components or pieces can be assembled together in proper relationship using adhesive, interlocking between components, and/or over-molding to collectively form the desired final fugitive insert configuration.

The fugitive insert 50, whether one-piece or multi-piece, can be molded from a fugitive material that can tolerate the temperature conditions typically employed to form ceramic cores using thermoplastic or thermosetting binders by injection or transfer molding, or pouring. Such temperature can range from 100 to 400 degrees F. For purposes of illustration and not limitation, the fugitive insert 50 can be made of soluble resins or high temperature liquid crystal polymers, that are soluble in water or other liquids such as alcohols, mild or strong acids, keytones and mineral spirits.

Figure 3B:
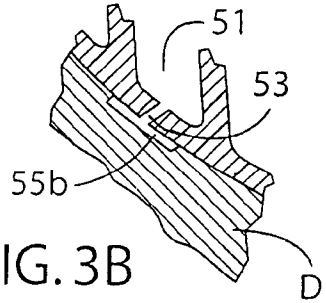
FIG. 3B is an enlarged view of the region B of FIG. 3.

FIG. 3 shows the fugitive insert 50 placed in the core molding die D with FIGS. 3A and 3B showing enlarged views of the regions A and B, respectively, of FIG. 3. The fugitive insert 50 can be positioned in proper relationship in the cavity of the molding die using molded-on surface features of the insert 50 itself and/or by using positioning pins (not shown) otherwise known as locating pins or chaplets. The ceramic material is introduced into the molding die to fill the cavities 51, passages 53, and mold wall-forming cavities 55 and is allowed to cure and/or set for a time to reach a rigid ceramic state. To this end, for purposes of illustration and not limitation, the ceramic material can comprise silica based, alumina based, zircon based, zirconia based, yttria based, erbia based or other suitable core ceramic materials in slurry mixtures known to those skilled in the art containing a thermoplastic or thermosetting binder. Suitable ceramic core materials are described in U.S. Pat. No. 5,394,932, which is incorporated herein by reference. The core material is chosen to be chemically leachable from the cast turbine airfoil formed thereabout as is known. The ceramic material is initially fluid (e.g. a ceramic slurry) for injection or transfer molding, or pouring and cures and/or sets to the rigid state in the molding die.

FIG. 4 shows the ceramic core 100 and integral, cooperating mold wall portions 102*a*, 102*b* formed on the fugitive insert 50 as a result of the ceramic material filling the insert cavities 51, passages 53, and cavities 55*a*, 55*b* following removal of the assembly from the molding die D. In this embodiment of the invention, it is apparent that only a portion of the mold wall 102*a* is formed about the fugitive insert 50 in the preceding step shown in FIG. 3. According to one processing sequence, the fugitive insert 50 is selectively removed from the core 100 and the mold wall portions 102*a*, 102*b*, which then are fired at elevated temperature as described herein to develop desired core/wall strength for further processing. A second fugitive pattern, such as wax or plastic, is formed on the fired core 100 and the mold wall portions 102*a*, 102*b* to provide a pattern assembly. For example, the fired core 100 with integral mold wall portions 102*a*, 102*b* are placed in a pattern injection die, and a desired fugitive pattern is formed on the fired core 100 and integral mold wall portions 102*a*, 102*b*. The resulting pattern assembly resembles the assembly shown in FIG. 4 with a second pattern replacing the fugitive insert 50. To this end, the reference character P is shown immediately below the core insert reference numeral 50 in FIG. 4. Use of the second pattern may be advantageous to allow inclusion of further pattern root, platform or airfoil features at other section lines or planes of the turbine blade pattern that cannot be provided on the fugitive insert 50 due to core geometry complications and also allows selection and use of an easier-to-remove pattern material than insert material such that selective removal of the pattern from the final mold/core can be conducted more easily and completely than with the core insert material. The pattern assembly then is incorporated in a mold followed by removal of the pattern to yield a mold with internal integral core of the type shown as mold M and integral core 100 in FIG. 5.

In this processing sequence, the fugitive insert 50 or second pattern P can be selectively removed by dissolution if the insert or pattern comprises a soluble material, by thermal degradation if the insert or pattern comprises a thermal degradable material, or any other suitable means appropriate to the insert material being selectively.

According to another more direct processing sequence which may only be possible with some core geometries, the core 100 and the integral mold wall portions 102*a*, 102*b* on the fugitive insert 50, FIG. 4, are incorporated directly in the mold M followed by removal of the fugitive insert 50 to yield the mold M with internal core C of FIG. 5. The mold and integral core then are fired at elevated temperature as described herein to remove the core insert 50 and develop desired core/wall strength for casting of molten metal or alloy therein. This processing sequence eliminates the step of forming a second pattern P as described in the preceding two paragraphs.

In these processing sequences, the missing mold shell wall is formed in a further subsequent processing step where additional ceramic material is invested or otherwise formed about regions of the fired core 100 and integral mold wall portions 102*a*, 102*b* (first processing sequence) or about the unfired core 100 and mold wall portions 102*a*, 102*b* on fugitive insert 50 (second processing sequence) where missing the mold shell 102*a* as shown in FIG. 5 in a manner to form a complete mold shell M (i.e. the remainder of the mold wall. In this investing step, the mold wall portions 102*b* also function to interlock with the mold shell M to lock the core 100 in position. The mold shell M is invested by processing pursuant to conventional investment shell molding processing by repeated dipped in ceramic slurry, drained of excess slurry, and stuccoed with coarse grain ceramic stucco particles until the mold shell M of desired mold wall thickness is built-up.

Figure 7:
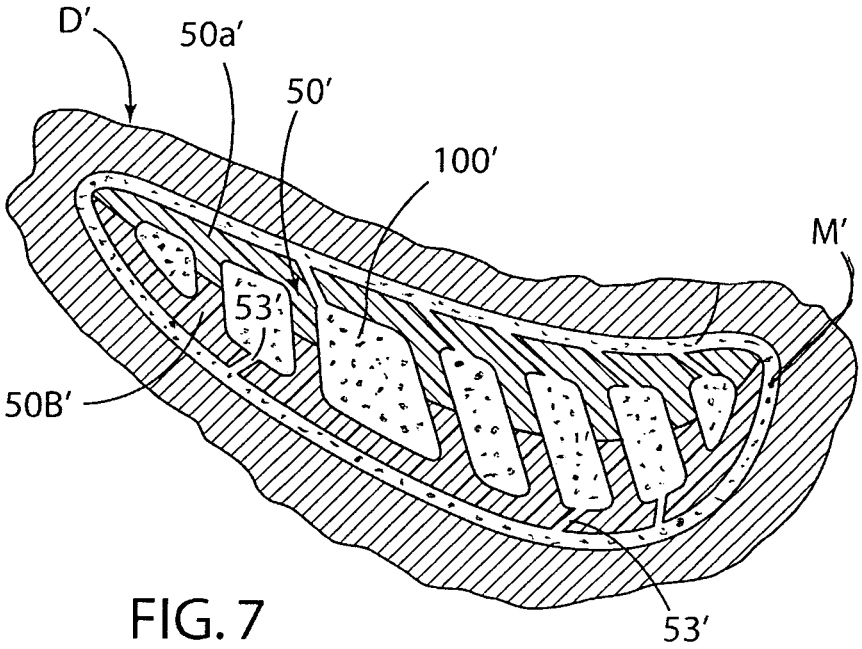
FIG. 7 is a sectional view of a transient (fugitive) insert residing in a first molding die which is designed to form a substantially complete mold shell and core about the insert when ceramic material is injection or transfer molded.

Alternately, referring to FIG. 7, the present invention can be practiced to form in one step a core 100' and a substantially complete integral, cooperating mold shell M' for casting a turbine airfoil or other article of manufacture. This embodiment is illustrated in FIG. 7 where the core 100' and mold shell M' are formed in molding die D'. In FIG. 7, like features of previous figures are represented by like reference numerals primed. This embodiment of the invention greatly reduces or eliminates the need for the investment shelling operations discussed above to complete a mold shell about the core.

The present invention is capable of forming different types of cast-in cooling air passages/exit hole configurations as illustrated in FIGS. 6A, 6B, 6C, 6D, and 6E, which illustrate a straight angled cooling passage 22 having external exit hole 20, an end-flared cooling passage 22 having an external exit hole 20, a convoluted cooling passage 22 having an external exit hole 20, a converging (i.e. focusing conical) cooling passage 22 having an external exit hole 20, and diverging (i.e. diverging conical) cooling passage 22 having an external exit hole 20, respectively, which can be formed using the fugitive insert 50 appropriately shaped to this end. These cast-in cooling hole configurations are offered for purposes of illustration and not limitation as other configurations can be formed by practice of the invention.

Referring back to FIG. 5, the assembly shown can be subjected to an appropriate high temperature firing treatment, such as sintering, to impart a desired strength to the mold shell M, mold wall portions 102*a*, 102*b*, and core 100 for casting. For casting a turbine blade 10, molten superalloy then is introduced into the mold cavity MC defined between the mold wall 102/mold shell M and the ceramic core 100 using conventional casting techniques. For example, molten superalloy can be poured into a pour cup (not shown) and gravity fed through a down sprue (not shown) to the mold cavity. The molten superalloy can be solidified in a manner to produce an equiaxed grain turbine blade, directionally solidified to form a columnar grain turbine blade, or solidified as a single crystal turbine blade casting. The mold wall 102/mold shell M are removed from the solidified cast turbine blade using a mechanical knock-out operation followed by one or more known chemical leaching or mechanical grit blasting techniques. The core 100 is selectively removed from the solidified cast turbine blade by chemical leaching or other conventional core removal techniques, yielding the turbine blade of FIG. 1 having the cast-in air cooling holes and passages shown wherein the core 100 forms internal cooling features such as cooling passages 22, 23 and the inner surface of the mold wall portions 102*a*, 102*b* form external features such as exit cooling holes 20 penetrating the adjacent external airfoil surface.

The present invention can produce core/mold wall geometries that require features that do not operate in common planes, including: (1) multiple skin core segments, (2) trailing edge features (e.g., pedestals and exits), (3) leading edge features (e.g., cross-overs), and (4) features that curve over the length of the airfoil. While one preformed fugitive insert 50 was over molded in the above description, in practice of the invention any number of preformed fugitive inserts can be preformed, assembled and over-molded with the ceramic material, FIG. 3.

Practice of the present invention is advantageous in that complex external cooling features, such as film cooling holes and/or cooling-enhancing turbulators, can be cast-in external cast airfoil surfaces in locations and/or orientations that are not possible by post-cast machining operations, such as drilling, with shapes and tapers to improve cooling performance and with improved external and internal casting wall thickness control. Further, the need for subsequent core pinning or locating is reduced or eliminated since the core not only forms the internal blade features, but also at least a portion of the external shell mold which more precisely locates the core with respect to the shell mold. The thermal expansion characteristics of the core and cooperating mold wall are matched at least at the local region and can be tailored to provide desired thermal and/or mechanical properties in the mold as a whole or locally to reduce hot tearing in equiaxed castings, local recrystallization in DS/SC castings, and/or provide local grain size control. Still further, a molten metal or alloy filter, such as a reticulated foam filter or lattice filter, can be molded into a down-sprue connected to the assembly of FIG. 5 to improve cleanliness of molten metal or alloy being delivered to the mold cavity.

It will be apparent to those skilled in the art that various modifications and variations can be made in the embodiments of the present invention described above without departing from the spirit and scope of the invention as set forth in the appended claims.

We claim:

1. A method of casting a metal or alloy turbine airfoil, comprising the steps of:

introducing ceramic slurry material around at least one fugitive insert to form a monolithic ceramic component consisting of a ceramic core and at least a portion of a cooperating ceramic mold wall;

wherein the at least one fugitive insert is configured so that the ceramic core of the monolithic ceramic component is configured to define one or more internal cooling air passages in the turbine airfoil and monolithically connect to the portion of the cooperating ceramic mold wall of the monolithic ceramic component, wherein the portion of the cooperating ceramic mold wall has an inner surface configured to define multiple external, cast-in film cooling air exit holes that penetrate a) through at least one of an external convex airfoil surface of an outer wall of the turbine airfoil and an external concave airfoil surface of the outer wall, b) at different angular orientations and locations that do not operate in common planes;

selectively removing the at least one fugitive insert;

inserting the monolithic ceramic component consisting of the ceramic core and the portion of the cooperating ceramic mold wall into a separate mold, the separate mold having an outer perimeter wall, the outer perimeter wall having a through-hole formed therein, wherein during the inserting step, the cooperating ceramic mold wall fitted with the through-hole completes the outer perimeter wall;

solidifying a molten metal or alloy in the mold about the ceramic core of the monolithic ceramic component; and removing the monolithic ceramic component consisting of the ceramic core and the portion of the cooperating ceramic mold wall to form the cast turbine airfoil having the multiple external, cast-in film cooling air exit holes to be in a fluid communication with the one or more internal cooling air passages to provide for film cooling of at least one of the external convex airfoil surface and external concave airfoil surface.

2. The method of claim 1, wherein the at least one fugitive insert is removed before the monolithic ceramic component consisting of the ceramic core and the portion of the cooperating ceramic mold wall is inserted into the separate mold.

3. The method of claim 1, wherein the at least one fugitive insert is removed after the monolithic ceramic component consisting of the ceramic core and the portion of the cooperating ceramic mold wall is inserted into the separate mold.

4. The method of claim 1, wherein introducing the ceramic slurry material around the at least one fugitive insert comprises:

placing the at least one fugitive insert in a molding cavity and injection molding, transfer molding, or pouring the ceramic slurry material into the molding cavity.

5. The method of claim 1, wherein the at least one fugitive insert is molded.

6. The method of claim 1, wherein the at least one fugitive insert comprises a soluble material.

7. The method of claim 1, wherein the at least one fugitive insert is selectively removed by dissolution.

8. The method of claim 1, wherein the at least one fugitive insert comprises a thermally degradable material.

9. The method of claim 1, wherein the at least one fugitive insert is selectively removed by heating.

10. The method of claim 1, wherein the at least one fugitive insert comprises a resin or liquid crystal polymer.

11. The method of claim 1, wherein introducing the ceramic slurry material around the at least one fugitive insert comprises;

assembling two or more fugitive inserts or partial fugitive inserts and introducing the ceramic slurry material around the assembled two or more fugitive inserts or partial fugitive inserts.

12. The method of claim 1, wherein each of the multiple external, cast-in film cooling air exit holes penetrates through the outer wall of the turbine airfoil to form a respective cast-in cooling air passage in the outer wall.

13. The method of claim 12, wherein the one or more cooling air passages comprise a converging passage.

14. The method of claim 12, wherein the one or more cooling air passages comprise a diverging passage.

15. The method of claim 12, wherein the one or more cooling air passages comprise a straight passage.

16. The method of claim 12, wherein the one or more cooling air passages comprise an end-flared passage.

17. The method of claim 12, wherein the one or more cooling air passages comprise a convoluted passage.

18. The method of claim 1, wherein the turbine cast airfoil is an equiaxed grain airfoil.

19. The method of claim 1, wherein the turbine cast airfoil is a columnar grain or single crystal airfoil.

20. The method of claim 1, wherein introducing the ceramic slurry material around the at least one fugitive insert comprises;

introducing the ceramic slurry material to form a remainder of the cooperating ceramic mold.

21. The method of claim 1, wherein the at least one fugitive insert comprises a one-piece fugitive insert.

22. The method of claim 1, wherein the at least one fugitive insert comprises a multi-piece fugitive insert.

23. The method of claim 1, wherein the at least one fugitive insert comprises a molded fugitive insert overmolded on a preformed fugitive insert.

24. A cast metal or alloy turbine airfoil having a monolithic ceramic component remaining thereon after casting, wherein the monolithic ceramic component consists of:

a ceramic core, and at least a portion of a cooperating ceramic mold wall;

wherein the monolithic ceramic component is configured to be inserted into a separate mold, the separate mold having an outer perimeter wall, the outer perimeter wall having a through-hole formed therein, wherein the cooperating ceramic mold wall is configured to be fitted with the through-hole to complete the outer perimeter wall; and wherein the ceramic core is configured to define one or more internal cooling air passages in the turbine airfoil and monolithically connect to the portion of the cooperating ceramic mold wall, wherein the portion of the cooperating ceramic mold wall has:

an inner surface configured to define multiple external, cast-in film cooling air exit holes that penetrate a) through at least one of an external convex airfoil surface of an outer wall of the turbine airfoil and an external concave airfoil surface of the outer wall of the turbine airfoil, b) at different angular orientations and locations that do not operate in common planes, so as to allow, after the monolithic ceramic component is removed, the multiple external, cast-in film cooling air exit holes to be in a fluid communication with the one or more internal cooling air passages to provide for film cooling of at least one of the external convex airfoil surface and the external concave airfoil surface.

25. The airfoil of claim 24, wherein each of the multiple external, cast-in film cooling air exit holes penetrates through the outer wall of the turbine airfoil to form a respective cast-in cooling air passage in the outer wall.

26. The airfoil of claim 25, wherein the one or more internal cooling air passages comprise a converging passage.

27. The airfoil of claim 25, wherein the one or more internal cooling air passages comprise a diverging passage.

28. The airfoil of claim 25, wherein the one or more internal cooling air passages comprise a straight passage.

29. The method of claim 25, wherein the one or more internal cooling air passages comprise an end-flared passage.

30. The method of claim 25, wherein the one or more internal cooling air passages comprise a convoluted passage.

* * * * *